United States Patent [19]

Hanson et al.

[11] 4,282,674

[45] Aug. 11, 1981

[54] TOY CASH REGISTER

[75] Inventors: Steven P. Hanson, Brea, Calif.; Palmer J. Schoenfield, Evanston; Harry Disko, S. Barrington, both of Ill.

[73] Assignee: Marvin Glass & Associates, Chicago, Ill.

[21] Appl. No.: 118,622

[22] Filed: Feb. 4, 1980

[51] Int. Cl.[3] ..... A63H 33/30; G09F 3/04; A63B 71/00

[52] U.S. Cl. ..... 46/39; 46/2; 46/175 R; 40/450; 40/451; 273/142 JB; 235/1 E

[58] Field of Search ..... 46/39, 2, 1 R, 5, 234, 46/269, 175 R, 18, 232, 191; 235/1 E, 124, 1 C, 92 GA; 414/915; 273/142 JB, 142 R, 142 B, 13 BA; 40/447, 450, 451, 490, 219, 474; 35/9 B, 9 C, 9 D, 9 R, 24 R; D21/124; 200/85 R, 51 LM

[56] References Cited

U.S. PATENT DOCUMENTS

| | | | |
|---|---|---|---|
| 1,239,036 | 4/1917 | Pfeifer | 46/191 |
| 2,223,119 | 11/1940 | Müller | 46/191 |
| 2,889,634 | 6/1959 | Bragmann | 35/9 C |
| 2,979,624 | 4/1961 | Askerneese | 200/51 LM |
| 3,127,176 | 3/1964 | Ryan | 46/39 |
| 3,509,643 | 5/1970 | Kane | 35/9 C |
| 3,535,796 | 10/1970 | Dean | 35/9 R |
| 3,762,715 | 10/1973 | Howard | 273/142 JB |
| 3,792,236 | 2/1974 | Dobras et al. | 235/472 |
| 3,892,945 | 7/1975 | Lerner | 200/85 R |
| 4,083,120 | 4/1978 | Brendle | 35/9 C |
| 4,195,423 | 4/1980 | Iwao | 235/1 E |

FOREIGN PATENT DOCUMENTS

| | | | |
|---|---|---|---|
| 2503805 | 8/1976 | Fed. Rep. of Germany | 46/39 |
| 391500 | 5/1933 | United Kingdom | 273/142 JB |

*Primary Examiner*—Robert Peshock
*Assistant Examiner*—Michael J. Foycik
*Attorney, Agent, or Firm*—Mason, Kolehmainen, Rathburn & Wyss

[57] ABSTRACT

A toy cash register for young children and the like includes a housing having an indicia display window formed on a portion thereof with an indicia display disc mounted behind the window having a plurality of different indicia thereon for selective display through the window. An electric motor is provided for driving the display disc and a plurality of push button controlled, momentary contact switches are provided for connecting the motor with an electric power source for rotating the display disc for random periods of time when the contacts are closed. The cash register includes an indexing system for automatically indexing the nearest set of indicia on the disc with the window after the disc drive motor is deenergized. A sound generator is activated by rotation of the display disc and the cash register also includes a weighing scale, a credit card facility and a manually controllable cash drawer along with a remote, hand held implement simulating an electronic tag reader.

14 Claims, 8 Drawing Figures

Fig 1
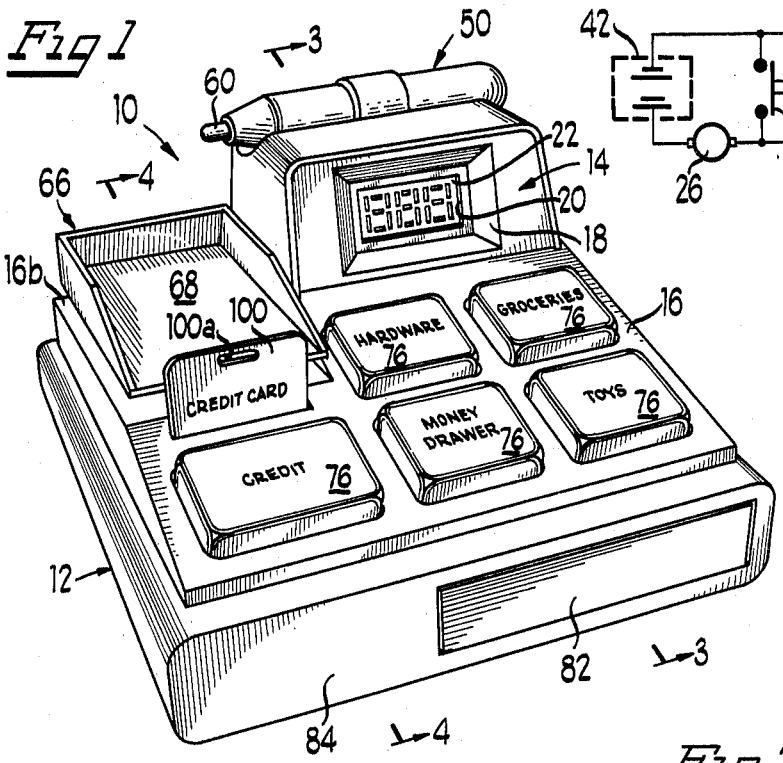
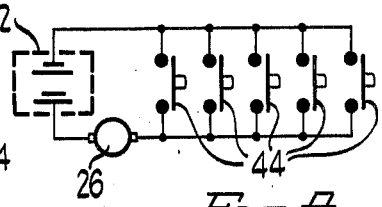
Fig 8
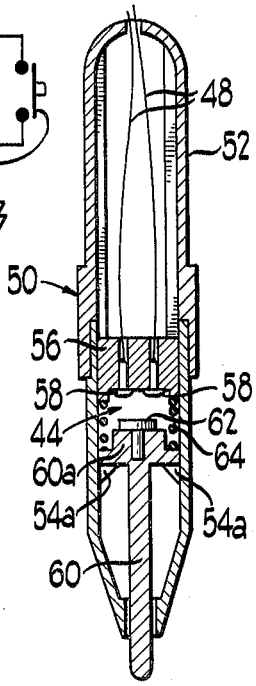
Fig 7
Fig 2
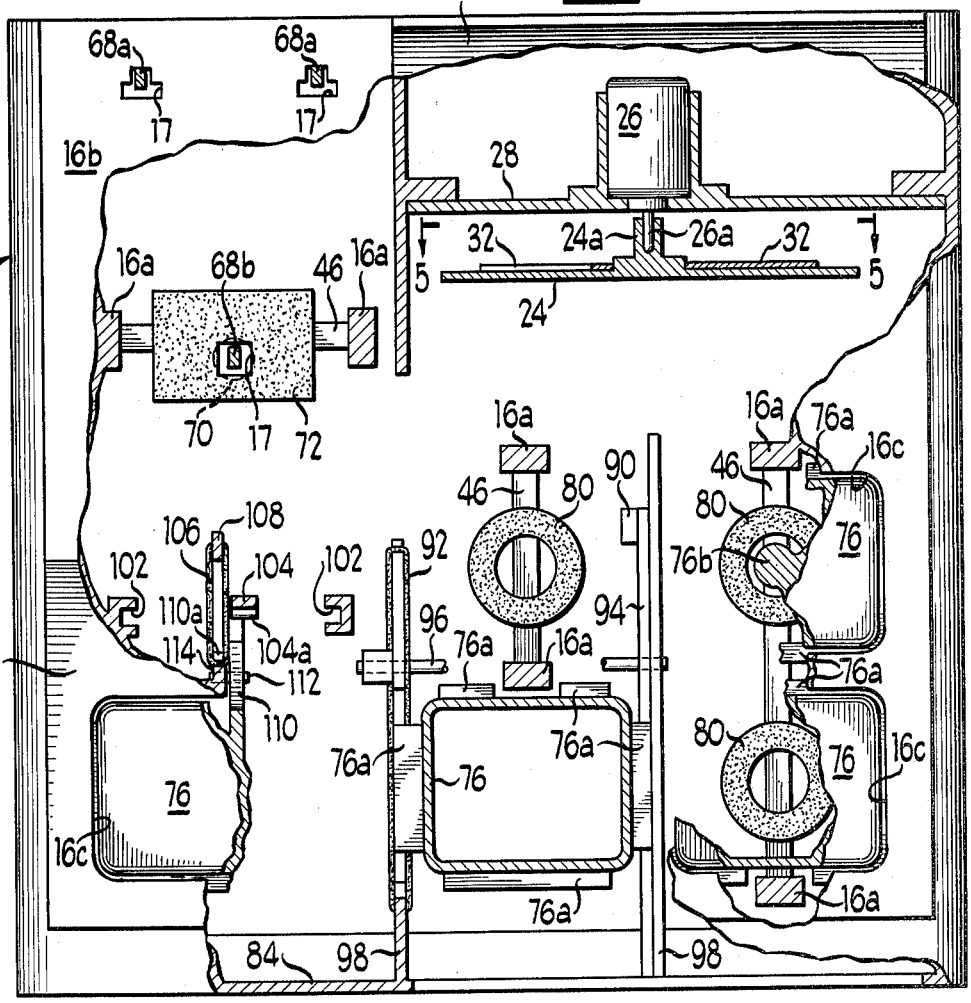

TOY CASH REGISTER

BACKGROUND OF THE INVENTION

1. Field of the Invention

The present invention relates to toy cash registers and more particularly relates to a multifaceted toy cash register having a number of features closely simulating the action of a modern day, electronic cash register facility.

2. Description of the Prior Art

Many types of relatively simple, mechanically operated toy cash registers have been provided as toys for young children and the like. More complex toy cash registers have also been developed wherein mathematical functions of addition, subtracting, etc. are registered and displayed. As far as is known, however, no toy cash registers have been provided wherein an indicia display element in the form of a rotary disc is mounted behind a window in a cash register housing and is controlled by a plurality of push button controlled, electric switches for momentarily energizing an electric motor driving the display disc for random periods of time. Moreover, the toy cash register includes an automatic indexing system for aligning a nearest set of indicia on the disc with the display window after the power to the electric motor is disconnected.

OBJECTS OF THE PRESENT INVENTION

It is an object of the present invention to provide a new and improved toy cash register and more particularly a new and improved toy cash register especially adapted for use at play for young children of tender years.

It is another object of the present invention to provide a new and improved toy cash register of the character described having a plurality of features such as a weighing scale, a credit card facility, a money drawer, a remote tag reader implement and a plurality of punch keys for controlling a display disc.

Another object of the present invention is to provide a new and improved toy cash register of the character described which provides both visual and audible signals during play.

Still another object of the present invention is to provide a new and improved toy cash register which is neat in appearance, simple in construction and economical to produce.

SUMMARY OF THE INVENTION

The foregoing and other objects and advantages of the present invention are accomplished in an illustrated embodiment by way of demonstration and not limitation, which embodiment includes a new and improved toy cash register having a housing with an indicia display window formed in a wall portion thereof. An indicia display element in the form of a rotary disc having sets of indicia on the face thereof is mounted for rotation with radial segments thereof, selectively viewable through the display window of the housing. An electric motor is provided for rotating the disc when energized and a plurality of push button controlled switches are interconnected with various elements on the cash register including punch keys, a weighing scale and a remote tag reader for energizing the electric motor for random periods of time so that different sets of indicia on the display disc may randomly appear in the window when the motor is deenergized.

The toy cash register also includes a credit card receptacle and a mechanically operated cash drawer and is provided with sound generating means activated by rotation of the display disc. An automatic system is provided for indexing the disc so that a nearest set of indicia will properly register with the indicia display window for viewing after electric power to the motor is disconnected.

BRIEF DESCRIPTION OF THE DRAWINGS

For a better understanding of the present invention, reference should be had to the following detailed description taken in conjunction with the drawings, in which:

FIG. 1 is a front perspective view of a toy cash register constructed in accordance with the present invention;

FIG. 2 is a top plan view of the cash register with portions broken away and in section showing internal components thereof;

FIG. 7 is a longitudinally extending, cross-sectional view of a remote tag reader accessory for the toy cash register in accordance with the present invention; and FIG. 8 is a schematic diagram of an electrical circuit of the cash register of the present invention.

DESCRIPTION OF THE PREFERRED EMBODIMENT

Figure 3:
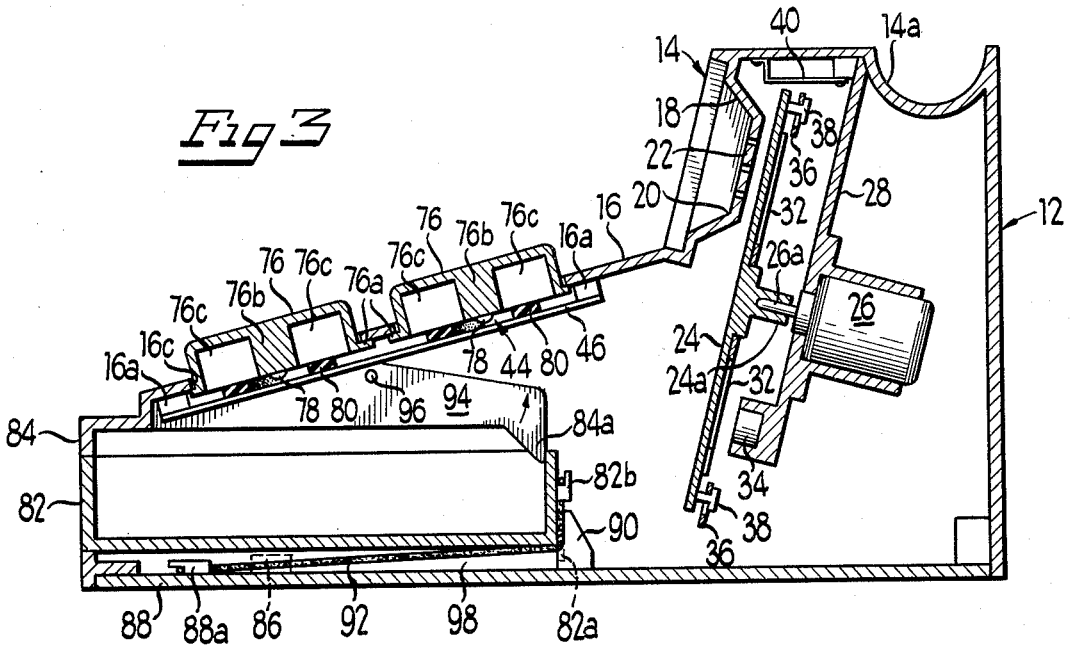
FIG. 3 is a vertical cross-sectional view taken substantially along lines 3—3 of FIG. 1.

Referring now more particularly to the drawings, in FIG. 1 is illustrated a new and improved toy cash register constructed in accordance with the features of the present invention and referred to generally by the reference numeral 10. The cash register includes a housing 12, preferably formed of molded plastic material and including an upwardly extending, window compartment 14 on a right-hand, rearward corner portion as viewed in FIG. 1. The window compartment projects upwardly above the level of an adjacent forwardly and downwardly sloping top wall 16 of the housing. The window compartment is formed with a recessed front wall 18 defined therein, with a rectangular window-like framed opening 20 provided with a panel 22 having a plurality of elongated slots therein arranged in a pattern to represent digital display information similar in appearance to that of liquid crystal displays commonly found in watches and clocks.

In accordance with the invention, spaced rearwardly of the slotted window panel 22 is provided a circular display disc 24 having a planar front face and formed with a central spindle **24*a* mounted on a shaft 26*a* of a low voltage, DC motor 26 as shown in FIGS. 2 and 3. The motor is supported in a recess or receptacle formed in a downwardly extending, internal wall segment 28 having a face parallel and spaced behind the slotted window panel 22 as best shown in FIGS. 2 and 3. When the motor is energized by low voltage DC current, the rotor disc 24 spins about the shaft axis of the motor. The front face of the disc is viewable through the slots of the window panel 22**.

Figure 5:
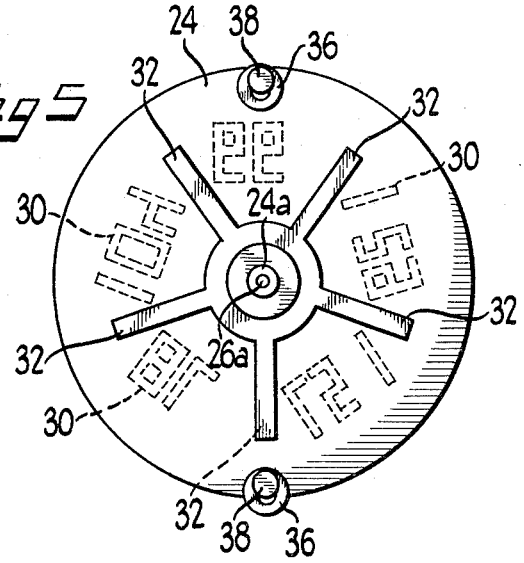
FIG. 5 is a front elevational view looking in the direction of arrows 5—5 of FIG. 2, illustrating the front face of an indicia display disc in accordance with the present invention.

Referring to FIG. 5, on the forward face of the display disc there is provided several sets of numerical indicia 30 selected to represent price information and positioned to be viewed through the slots in the window panel when a particular set of indicia is indexed in registration therewith. For this purpose, on the back side of the rotating disc there is provided a plurality of radially extending metal spokes 32 formed of magnetic material and positioned to separate the several sets of numerical indicia 30 on the disc with one set centered within a radial segment bounded between a pair of adjacent spokes.

In order to index the display disc so that each set of indicia 30 will appear in precise registration behind the slotted window panel 22 on a randomly selected basis determined by its position relative to the window when the motor 26 is deenergized, a permanent indexing magnet 34 is mounted on the internal wall 28 directly below the motor shaft. Preferably, an odd number of magnetic spokes 22 are mounted on the display disc so that each set of indicia 30 is directly opposite a spoke on the disc. When electrical power to the motor is disconnected, the momentum of the turning rotor disc 24 will continue the rotation briefly until the attraction of the permanent magnet 34 is sufficient to align and center one of the magnetic material spokes 32 directly in front of the magnet as the disc stops rotation. When this occurs, a set of numerical indicia 30 directly above the vertically, downwardly extending spoke is displayed in precise registration behind the slots in the window panel 22 to provide an indication of price for the toy cash register.

In addition to the presentation of visual indicia for viewing through the slotted window 22, the display disc 24 is provided with a pair of bell ringers in the form of washers 36 that are loosely mounted on headed fasteners 38 provided at diametrically opposed positions adjacent the outer periphery of the disc. The loosely mounted washers are adapted to strike a chime or bell element 40 mounted in the upstanding window compartment 14. Each washer rings against the element as the circular disc is rotated during energization of the motor 26. Thus, the production of audible as well as visual effects closely simulates the action of a real-life cash register.

Referring briefly to FIG. 8, an electrical circuit is provided in the cash register housing 12 to energize the motor 26 and the circuit includes a battery 42 of one or more dry cells connected in series with the motor and a plurality of momentary contact switches 44 which are wired in parallel with one another so that momentary closing of any one of the switches will energize the motor 26. Each of the momentary contact switches 44 that is mounted in the housing 12 includes a stationary contact element 46 supported below the upper surface of the housing top wall 16 on depending lug portions **16*a* integrally formed on the underside of the top wall at appropriate locations as shown in FIGS. 2 and 3**.

In addition to the switches mounted in the housing 12, another switch 44 is provided in an elongated, generally cylindrically-shaped, hollow, tag reading implement 50 which resembles a pen or pencil and is interconnected with the circuitry in the housing by a pair of elongated, flexible wires 48. The tag reading implement includes a hollow housing with hollow, tubular casing portions 52 and 54 joined together adjacent a mid portion on the longitudinal axis of the implement as shown in FIG. 7. An intermediate wall or plug 56 is mounted internally of the housing to carry a pair of contact eyelets or rivet-like switch elements 58 seated in spaced apart passages in the plug and these elements are connected to the respective flexible wires 48 which pass outwardly through the rounded outer end of the hollow back or rear casing element 52.

The forward end of the front casing element 54 is frustoconically tapered as shown and is provided with a central aperture in the outer end wall in order to accommodate the rounded outer end portion of a pencil-like stem element 60 having a piston-like portion **60*a* at the inner end which is slidably disposed in the cylindrical portion of the front or forward casing member 54 of the implement as illustrated in FIG. 7**.

A switch contact button 62 is mounted on the piston portion **60*a* for movement to momentarily provide a bridging contact between the spaced apart contact buttons 58 when the rounder outer end of the stem is biased inwardly by contact with an external object or tag. A coil spring 64 is mounted in the casing to bias the piston 60*a* of the stem element outwardly so that the switch 44 of the implement 50 is normally open until such time as the rounded outer end of the stem is pushed inwardly to make electrical contact between the heads of the contact button 58. When this occurs, battery power is supplied to energize the motor 26 and turn the indicia display disc 24** until contact is broken by release of pressure against the rounded outer end of the stem.

The top wall portion **14*a* of the upstanding window compartment 14 (FIG. 3) is formed with an elongated semi-cylindrically shaped recess in order to accommodate the tag reading implement 50 when the implement is not being used and is in the stored or rest position as shown in the perspective view of FIG. 1. The amount of outward travel of the stem 60 under the influence of the spring 64 is limited by one or more stop gussets 54*a* provided on the inside wall of the casing element 54 and the piston portion 60*a* of the stem normally engages these gussets preventing further outward movement of the stem. When the pencil-like card reading implement 50 is held in the hand and the tip of the stem is moved into engagement with a tag or other surface with sufficient pressure to force the rounded outer end portion of the stem element to close the contacts of the switch as described, the motor 26** is energized and the disc rotates and sound is generated. When pressure on the tip of the stem element is subsequently released, the switch is opened and the motor is deenergized.

Figure 4:
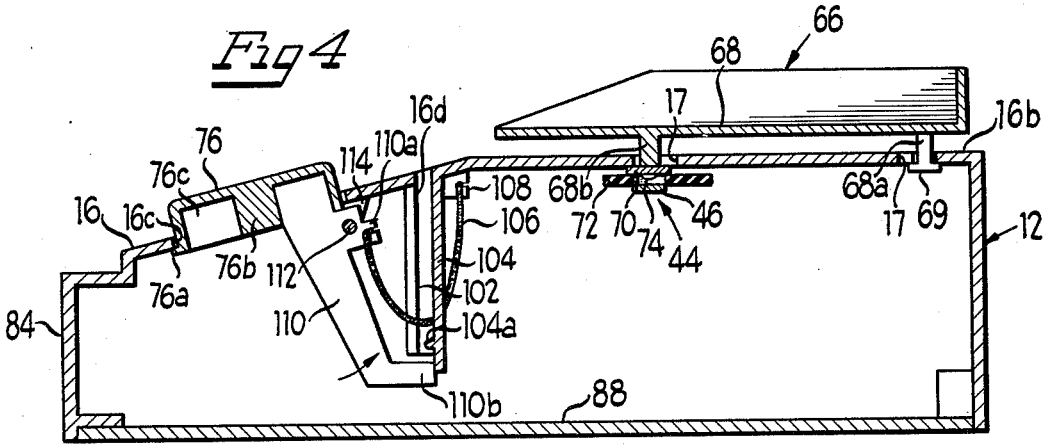
FIG. 4 is a vertical, cross-sectional view taken substantially along lines 4—4 of FIG. 1.

In accordance with the present invention, the cash register toy also includes a weighing scale assembly 66 mounted to the left of the upstanding window compartment 14 on a horizontal or flattened out, horizontal segment **16*b* of the top wall 16 of the housing as best shown in FIG. 4. The weigh scale assembly includes a trough-like scale pan 68 having a plurality of downwardly extending, integral, support legs 68*a* and 68*b* on the underside thereof. A rear pair of the support legs 68*a* project downwardly through T-shaped slots 17 formed in the housing top wall section 16*b* and the lower ends of the rearward legs 68*a* are provided with washer-like headed enlargements 69 to limit upward travel of the scale pan relative to the housing. The single, front or forward leg 68*b* of the scale pan extends downwardly through a square-shaped opening 17** (FIG.

2) and is provided with a circular, electrical contact element attached on the lower end of the leg and adapted to be depressed downwardly toward an underlying stationary electrical switch contact bar 46. The scale pan is biased upwardly by a sponge rubber pad having a square-shaped opening therein which is smaller than the circular contact disc 70 so that the disc and scale pan are biased upwardly with the disc normally maintained away from the stationary contact bar 46 as shown in FIG. 4. A round headed metal fastener 74 is used to secure the circular contact disc 70 onto the lower end of the scale pan leg 68*b* and the rounded head of the fastener provides a movable, electrical switch contact member for directly engaging the stationary contact bar 46 to make and break contact therewith to energize the motor 26 whenever sufficient weight is placed upon the scale pan 68 to depress the sponge rubber pad 72 enough to permit contact between the switch elements 46 and 70.

It will thus be seen that the weight scale assembly is effective to energize the motor 26 to rotate the indicia display disc 24 whenever a sufficient weight is placed on the scale pan 68 and when the weight is removed, the momentary contact between the rounded headed contact fastener 74 and the stationary contact bar 46 is broken to deenergize the motor.

In accordance with the present invention, a right-hand, lower portion of the sloping top wall 16 of the housing 12 is formed with a plurality of relatively large, rectangular-shaped, openings 16*c* having rounded corners and arranged in a matrix pattern of rows and columns. Two openings are aligned in an upper row and three openings in an lower row as best shown in FIGS. 1 and 2. In each of these openings, there is provided a large, rectangular-shaped convex, push button 76 preferably formed of molded plastic material and formed with a rectangular-shaped, flat upper surface and a depending peripheral skirt extending downwardly into the associated opening in the top wall of the cash register housing. Outwardly extending stop flanges 76*a* are integrally formed along the lower edges of the peripheral skirt and these flanges engage the under side of the housing top wall 16 along the edges of the openings 16*c* to limit the upward travel of the push buttons relative thereto.

As illustrated in FIG. 1, the pair of push buttons in the upper row are provided with the words "hardware" and "grocery," respectively, on the upper surface thereof and the three push buttons in the lower row are provided with the words "credit," "money drawer" and "toys" on the upper surface thereof. These indicia may be provided by integrally molded letters or by decals or tags secured thereto.

The "hardware," "groceries" and "toys" push buttons are adapted to control respective momentary contact switches 44 for energizing the display disc drive motor 26 when the push buttons are depressed and for this purpose, the push buttons are formed with a downwardly depending integral stem 76*b* at the center thereof upon which is mounted a round headed switch contact element 78 (FIG. 3) adapted to make and break contact with a stationary contact bar 46 centered below the respective push buttons as shown in FIG. 2. The push button 76 labeled "hardware," "groceries" and "toys" are biased upwardly in the openings 16*c* of the housing top wall 16 by means of donught-shaped elements 80 formed of resilient, cellular, sponge-like material such as foam rubber, and these biasing elements are mounted between the upper surface of the stationary contact bars 46 and the lower edges of integrally formed ribs 76*c* extending between the central depending contact support post 76*b* and the outer peripheral skirt of the push buttons as shown in FIG. 3.

Accordingly, when downward pressure on the respective push buttons is released, the sponge rubber elements expand to their normal thickness and bias the contact buttons upwardly until the stop flanges 76*a* engage the under side of the top wall 16 around the edges of the openings 16*c* as illustrated in FIG. 3. In the upward position as shown, the centrally positioned switch contacts 78 on the respective push buttons are spaced away from the fixed contact bars 46 and the switches 44 are thus normally open switches which are closable momentarily by downward pressure on the respective push buttons.

In accordance with the present invention, the toy cash register also includes a money drawer 82 slidable into and out of the housing and mounted below the top wall 16. The drawer is guided for horizontal movement between an inward or closed position (FIGS. 1 and 3) wherein the outer face of the drawer is flush with a front wall 84 of the housing and outwardly extending or open position wherein an open upper end of the money drawer is readily accessible. Movement of the money drawer is limited by an open position stop 86 provided on the upper surface of a housing bottom wall 88 and adapted to engage a depending stop element 82*a* on the rear wall of the slidable money drawer. In addition, another drawer stop 90 is provided on the bottom wall 88 to engage the rear wall of the drawer and limit the inward travel thereof in the housing as shown in FIG. 3.

The money drawer is biased towards the outward or open position by an elongated rubber band 92 which has a rearward end hooked around a hook-like projection 82*b* formed on the rear wall of the money drawer and a forward end of the rubber band is looped around a similar projection 88*a* formed on the upper surface of the housing bottom wall. Normally, the money drawer 82 is maintained in the closed position as shown in FIG. 3 by engagement of a downwardly depending finger 84*a* on the rearward or inner end of a pivotally mounted drawer release lever 94 which is mounted for pivotal movement on an axle pin 96 extending between a pair of inwardly extending drawer guides 98 as shown in FIGS. 2 and 3. Downward depression of the push button 76 labeled "money drawer" causes the detent finger 94*a* of the drawer release lever 94 to move upwardly as indicated by the arrow and out of engagement with the rear wall of the money drawer which is then free to slide out to the open position under the biasing force of the tensioned rubber band 92. Outward movement of the drawer is limited by engagement of the depending stop lug 82*a* on the rear wall of the money drawer with the open drawer stop 86 formed on the housing bottom wall 88.

As illustrated in FIG. 2, downward movement of the push button 76 labeled "money drawer" causes a flange 76*a* thereof to downwardly depress a forward end portion of the drawer release lever 94 and this action moves the rearward end upwardly to disengage from the rear wall of the cash drawer so that the drawer may open. Subsequent manually incurred inward movement of the drawer causes the rear wall thereof to cammingly engage a forward sloped surface on the depending finger or latch 94*a* of the drawer release lever. When the rear end wall of the drawer is stopped against the rear drawer stop 90, the detent finger of the drawer release lever then drops downward into the drawer engaging position to retain the money drawer in the closed position as shown against the opening bias of the rubber band 92 until such time as the door release lever is unlatched by pivotal movement in a counterclockwise direction when the push button 76, labeled "money drawer" is again depressed.

Figure 6:
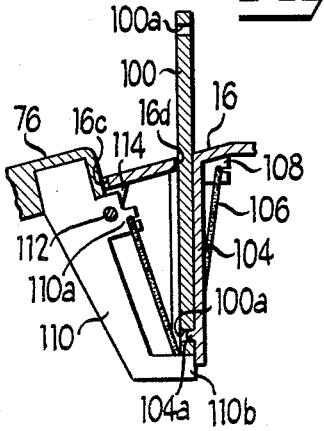
FIG. 6 is a fragmentary, cross-sectional view similar to FIG. 4 illustrating a credit card receiving feature of the cash register of the present invention in an operating position.

In accordance with another feature of the present invention, the toy cash register 10 includes a credit card receiving accessory comprising a thin card receiving slot 16*d* formed in the sloping segment of the top wall 16 adjacent the forward end of the weigh scale assembly 66 as shown. The card slot 16*d* is adapted to receive a generally rectangular credit card 100 when inserted downwardly therein as shown in FIGS. 1 and 6. The credit card 100 is adapted to be inserted into the slot 16*d* and then is moved vertically while guided on opposite edges by a pair of integrally formed, downwardly extending guides 102 of channel-shaped, transverse cross-section which are positioned at opposite ends of the receiving slot.

The credit card is formed with elongated slots 100*a* adjacent each end and these slots are adapted to interact with a rib 104*a* provided on the forward face of a depending, integrally formed, deflectable holding finger 104 mounted adjacent the rear edge of the receiving card slot 16*d* as shown in FIG. 6. When fully inserted in the slot and depressed downwardly, the lower slot 100*a* of the credit card snaps over the rib 104*a* and the card is detained thereby until the rib is deflected rearwardly. A bias element such as an elongated rubber band 106 is provided to normally urge and move the credit card upwardly from the depressed position as shown in FIG. 6. A rear end of the rubber band is looped around a retaining hook element 108 depending downwardly on the under side of the housing top wall 16 and a mid portion of the rubber band is designed to be engaged by the lower end of a credit card when inserted into the slot 16*d* to exert tension on the rubber band as shown. The forward end of the rubber band is looped around a hook-like projection 110*a* formed on a credit card release lever 110 which is mounted for pivotal movement on an axle 112 secured to an integral depending bracket 114 provided on the under side of the housing top wall 16 as shown in FIGS. 4 and 6. An upper end portion of the release lever 110 is engaged with the under side of the push button 76 having the word "credit" on the upper surface thereof and downward depression of the lower end portion of the push button causes the release lever 110 to pivot in a counterclockwise direction as indicated by the arrow so that a lower end portion 110*b* thereof engages and deflects the lower end of the finger 104 to move the rib 104*a* out of holding engagement with the slot 100*a* at the lower end of the credit card. When this occurs, the rubber band 106 is then effective to move the credit card upward to a release position wherein the card can be withdrawn from the credit card receiving slot 16*d*.

From the foregoing, it will be seen that the cash register 10 in accordance with the present invention provides a variety of features and is especially well adapted for play and use by young children and the like.

Although the present invention has been described with reference to a single illustrated embodiment thereof, it should be understood that numerous other modifications and embodiments can be devised by those skilled in the art that will fall within the spirit and scope of the principles of this invention.

What is claimed as new and desired to be secured by Letters Patent of the United States is:

1. A toy cash register for young children and the like, comprising:

a housing having an indicia display window in a wall portion thereof;

an indicia display element having a plurality of indicia on a face thereof mounted in said housing with a portion viewable through said window and movable relative to said window for displaying different indicia thereof;

electric motor means for moving said display element;

manually operable means for momentarily connecting said motor means with an electrical power source for moving said display element, said display element comprising a disk mounted for rotation about a spin axis and driven by said motor means, said display window positioned radially outward of said spin axis and dimensioned to display only a limited radial segment of a face of said disk behind said window, said disk being divided into a plurality of said radial segments, each segment having indicia thereon for display through said window when aligned therewith, and indexing means for aligning each of said radial segments with said window after said motor means is deenergized, said indexing means comprising a plurality of radially extending elements on said disk between said segments and a fixed element mounted in said housing adjacent the path of travel of said radial elements rotating with said disk, said radial elements and said fixed element being magnetically attractable to center one of said radial elements in front of said fixed element whenever said disk is not rotating.

2. The toy cash register of claim 1 wherein said switch means includes a plurality of switch contacts mounted in a hand held implement connected to said housing with elongated flexible cord means.

3. The toy cash register of claim 1 or 2 wherein said switch means includes a plurality of switch contacts mounted in said housing for operation by depression of a push button carried on said housing.

4. The toy cash register of claim 1 including sound generator means in said housing activated to generate a sound when said display element is moved by said motor means.

5. The toy cash register of claim 4 wherein said sound generator means includes a bell and a ringer carried by said display element.

6. The toy cash register of claim 2 wherein said implement includes a hollow housing with a plurality of switch contacts in said housing, and a push button having one end extending out through an opening in the end of said housing for contact with external surface causing inward depression thereof to make electrical contact between said switch contacts therein.

7. The toy cash register of claim 6 including bias means urging said one end of said push button outwardly of said housing.

8. The toy cash register of claim 1 including scale means on said housing including a scale platform movable toward and away from said housing and wherein said switch means includes a plurality of switch contacts for operation by said platform in response to objects placed thereon.

9. The toy cash register of claim 8 including means for biasing said scale platform away from said housing in an upward direction to normally open said switch contacts.

10. The toy cash register of claim 1 wherein said housing is formed with a recess for receiving a credit card manually inserted therein, bias means for ejecting said credit card out of said recess, detent means engageable with said credit card for holding the credit card in said recess until released for ejection by said bias means and push button means on said housing operable to release said detent means.

11. The toy cash register of claim 10 wherein said detent means includes a portion deflectable by depression of said push button means and formed with a holding element thereon engageable to retain a credit card in said recess until said portion is deflected by operation of said push button.

12. The toy cash register of claim 1 including a cash drawer mounted for sliding movement in and out of said housing, bias means urging said drawer outwardly thereof, releasable detent means for retaining said drawer in said housing against the urging of said bias means and push button means on said housing operable to release said detent means.

13. The toy cash register of claim 1 including sound generator means in said housing activated by rotation of said disk by said motor means.

14. The toy cash register of claim 13 wherein said sound generator means includes a bell and one or more ringers mounted on said disk to strike said bell upon rotation of said disk.

* * * * *